United States Patent [19]

Phillips

[11] Patent Number: 4,542,757

[45] Date of Patent: Sep. 24, 1985

[54] UMBRELLA WITH ADVERTISING FLAG

[75] Inventor: Bradford E. Phillips, Cincinnati, Ohio

[73] Assignee: 'totes' incorporated, Loveland, Ohio

[21] Appl. No.: 486,708

[22] Filed: Apr. 20, 1983

[51] Int. Cl.[4] ..... A45B 25/30; G09F 3/00

[52] U.S. Cl. ..... 135/16; 40/317; 135/20 R; 135/25 R; 283/56

[58] Field of Search ..... 135/16, 20 R, 33 R, 135/34, 17, 18, 19, 19.5, 20 A, 20 B, 20 M, 21, 22, 23, 24, 33 C; 40/317; 283/80, 81, 56; D20/22; 156/DIG. 19; D3/5, 6, 10

[56] References Cited

U.S. PATENT DOCUMENTS

| | | | |
|---|---|---|---|
| 1,965,699 | 7/1934 | Goldstein | 40/317 |
| 3,467,115 | 9/1969 | Brooks et al. | 135/25 R |
| 4,336,817 | 6/1982 | Shapiro | 135/16 |

FOREIGN PATENT DOCUMENTS

| | | | |
|---|---|---|---|
| 1766 | 1/1894 | United Kingdom | 40/317 |

*Primary Examiner*—Robert A. Hafer
*Assistant Examiner*—Arnold W. Kramer
*Attorney, Agent, or Firm*—Wood, Herron & Evans

[57] ABSTRACT

An umbrella having a flexible cover that is usable in either a rib supported cover open position or a rib collapsed cover folded position. An advertising flag is attached to the umbrella cover, the advertising flag extending upwardly beyond the exterior surface of the cover when the umbrella is in the open position so as to display the advertising message thereon. Preferably the advertising flag is sized and positioned so that the flag is at least partially concealed between the folds of the umbrella cover when the cover is folded about the centerpost in the storage position.

1 Claim, 3 Drawing Figures

UMBRELLA WITH ADVERTISING FLAG

This invention relates to umbrellas. More particularly, this invention relates to an umbrella with a novel umbrella cover.

Umbrellas, of course, are very well known to the prior art. Basically, an umbrella is comprised of a centerpost with a cover and rib structure connected at one end, and a handle at the other end. In the storage position, the umbrella's cover and rib structure are collapsed against the centerpost, the folds of the cover formed in the collapsed position being wrapped around the centerpost and held thereagainst by, e.g., a strap fixed to the cover. The umbrella's cover is movable by the umbrella's user between the storage position and the canopy open or rain protective position by means of a runner and the rib structure system.

It is known to the prior art to use umbrellas for advertising purposes. In this regard, it is known to the prior art to provide advertising messages on the flexible cloth cover of an umbrella. In other words, the advertising message is printed or otherwise inscribed directly on the cloth cover. Such advertising messages on umbrellas are used to promote any number of different goods and services. Oftentimes, for example, a company's logo or trademark is imprinted on the umbrella cover, or a team's logo such as a football or baseball team is imprinted on the umbrella cover, and so forth.

It has been the primary objective of this invention to provide an improved umbrella that incorporates an advertising flag in combination with the umbrella. In accord with this objective, the umbrella of this invention includes a flexible cover that is usable in either a rib supported cover open position or a rib collapsed cover folded position. An advertising flag is attached to the umbrella cover, the advertising flag extending upwardly beyond the exterior surface of the cover when the umbrella is in the open position so as to display the advertising message thereon. Preferably the advertising flag is sized and positioned so that the flag is at least partially concealed between the folds of the umbrella cover when the cover is folded about the centerpost in the storage position.

Other objectives and advantages of this invention will be more apparent from the following detailed description taken in conjunction with the drawings in which.

Figure 1:
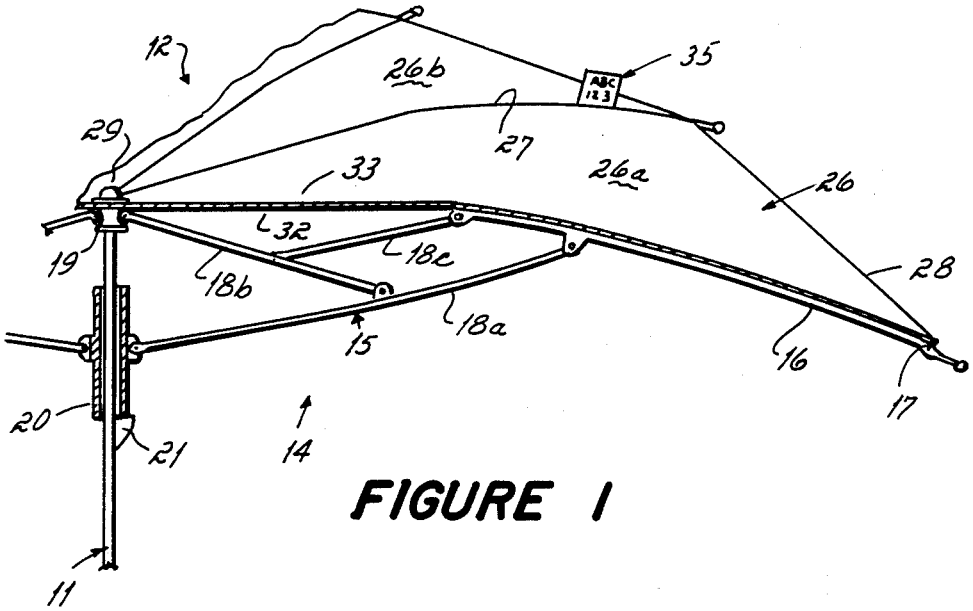
FIG. 1 is a partially broken away perspective view of an umbrella in accord with the principles of this invention, the umbrella's cover being illustrated in the canopy open position with the advertising flag exposed for view.
Figure 2:
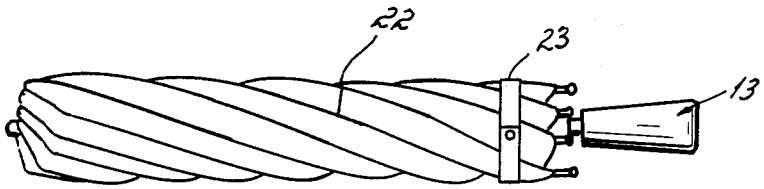
FIG. 2 is a side elevation of the umbrella shown in FIG. 1 but with the umbrella's cover being illustrated in the storage position.

An umbrella 10 in accord with this invention is illustrated in FIG. 1. The basic umbrella includes a centerpost 11 with a flexible fabric cover 12 fixed at the top end thereof, and with a handle 13 fixed to the bottom end thereof. A rib structure 14 is connected between the centerpost 11 and the umbrella's cover 12. The rib structure 14 is comprised of a series of rib sets 15 radiating radially from the centerpost 11. Each rib set 15 includes an outer cover support rib 16 fixed at its outer end to the cover by stitches 17. The outer rib 16 is connected by a group of linkage ribs 18*a*–18*c* to a ferrule 19 immobily mounted to the top end of the centerpost 11, and a runner 20 slidably carried on that centerpost. A spring loaded catch 21 cooperates with the runner to hold taughtly the umbrella's cover 12 in the full open or canopy position as illustrated in FIG. 1. The folds 22 of the umbrella's cover 12 that are created when the rib structure 14 is collapsed against the centerpost 11 permits the cover's folds to be wrapped around the centerpost and rib structure in folded configuration, the cover being held in place by a closure strap 23, as shown in FIG. 2. The specific details of an umbrella structure that is useful in this invention is illustrated in Brooks et al U.S. Pat. No. 3,467,115, the diclosure of which is incorporated herein by reference.

Figure 3:
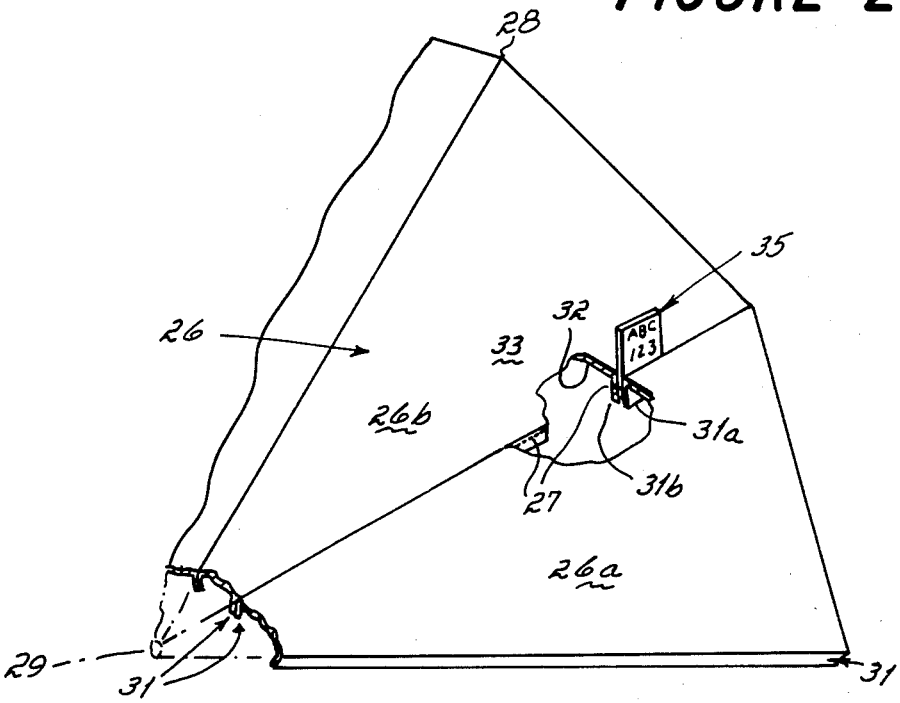
FIG. 3 is a partial view of the umbrella's cover illustrating construction of the cover's gores and the advertising flag.

The cover 12 used in the umbrella 10 of this invention is preferably fabricated of a flexible cloth fabric. However, it also may be assembled of plastic sheet material if desired. The cloth cover 12 is formed from a series of gores 26, the number of gores being equal to the number of rib sets 15 connected to the centerpost 11, e.g., a six gore cover has six rib sets and an eight gore cover makes use of eight rib sets. The gores 26 are overlapped on the inside face of the cover, and are sewn together by stitch line 27 from the outer edge 28 of the cover to the center 29 of the cover as shown in FIG. 3. These overlapped or selvage edges 31 of adjacent gores 26 of the umbrella cover 12 are both directed to the inside face 32 of the cover so that the umbrella cover presents of a smooth or finished exterior surface 33 appearance when the umbrella is erected in the canopy open position shown in FIG. 1.

An advertising flag 35, in accord with the principles of this invention, is sewn to the umbrella's cover 12 between adjacent gores 26 of the cover. The advertising flag 35, which may carry any advertising message (ABC/123 being the message shown) desired by the manufacturer, is positioned between the selvage edges 31*a*, 31*b* of adjacent gores 26*a*, 26*b* so that a substantial portion of the flag extends beyond the outer or exterior face 33 of the umbrella's cover 12 when the umbrella is opened as shown in FIG. 1. In this regard, therefore, the same stitch line 27 that stitches or connects adjacent gores 26*a*, 26*b* one to the other also stitches or connects the advertising flag 35 to the umbrella's cover 12 such that at least a portion of flag 35 extends inwardly of cover 12 between selvage edges 31*a*, 31*b* as seen in FIG. 3. In other words, when the advertising flag 35 is stitched to the umbrella's cover 12 in this fashion, i.e., between interior selvage edges 31*a*, 31*b* of adjacent cloth gores 26*a*, 26*b*, it tends to stick or extend up from the umbrella's cover exterior surface 33 when the umbrella is in the canopy open position shown in FIG. 1.

Preferably the advertising flag 35 is made of a flexible material, e.g., a cloth fabric, so that the flag is foldable or wrappable with the umbrella's cover 12 when it is in the storage position shown in FIG. 2. Note particularly that, in the preferred embodiment illustrated in this application, the advertising flag 35 is sized, and is positioned along the stitch line 27 of adjacent gores 26*a*, 26*b* relative to the centerpost 11, so that the advertising flag is substantially hidden between those cover's folds 22 when the cover's folds are wrapped around the centerpost 11 after the umbrella's rib structure 14 has been collapsed to the storage position, thereby making the flag not readily visible to a casual viewer of the stored umbrella as shown in FIG. 2. In other words, the advertising flag in this preferred embodiment is connected to the umbrella's cover 12, and is so sized relative to the umbrella cover's gores 26, that it is substantially hidden from view when the cover is folded and wrapped around the umbrella's centerpost when the umbrella is in the stored position.

Having described in detail the preferred embodiment of my invention, what I desire to claim and protect by Letters Patent is:

1. An umbrella comprising a centerpost, an umbrella cover connected to said centerpost, said cover comprising a series of gores, two of said gores adjacent one to the other being stitched together along a stitch line to form a pair of selvage edges extending inwardly of said cover so that said two adjacent gores present a generally smooth exterior surface appearance when said umbrella is open, a rib structure connected to the centerpost and to the umbrella cover, the rib structure being operable by a user to erect the cover into a cover open position and to collapse the cover into a cover closed position, the cover forming folds which are wrapped around the centerpost when the cover and rib structure are collapsed against the centerpost in the cover closed position, a closure strap fixed to said cover, said closure strap surrounding said cover exteriorly of said folds for holding said folded cover and rib structure collapsed against the centerpost, and an advertising flag connected to said cover between said adjacent gores, said advertising flag extending inwardly of said cover between said selvage edges so that said flag is stitched to said cover by the same stitch line that stitches said adjacent gores together, said advertising flag having a substantial portion extending outwardly of said cover that is adapted to carry an advertising message for view by a casual observer of said umbrella cover when said umbrella cover is in use in the cover open position, said outwardly extending portion of the advertising flag being sized so that the advertising flag extends generally upwardly from said cover when said umbrella cover is in the cover open position and further being sized and positioned on said cover so that said outwardly extending portion of the advertising flag is hidden from view between the folds of said cover when said cover is folded and held in said cover closed position by said closure strap.

* * * * *